United States Patent [19]

Pritchard et al.

[11] 4,105,931

[45] Aug. 8, 1978

[54] INDUCTOR STRUCTURES FOR ELECTRICAL DISCHARGE LAMP CIRCUITS

[75] Inventors: Eric Harry Pritchard; Thomas Rivers Passmore, both of London, England

[73] Assignee: Thorn Electrical Industries Limited, London, England

[21] Appl. No.: 726,622

[22] Filed: Sep. 27, 1976

[30] Foreign Application Priority Data

Oct. 3, 1975 [GB] United Kingdom ..... 40630/75

[51] Int. Cl.[2] ..... H05B 41/16

[52] U.S. Cl. ..... 315/278; 336/220

[58] Field of Search ..... 315/278; 336/206, 220–221

[56] References Cited

U.S. PATENT DOCUMENTS

| | | | |
|---|---|---|---|
| 3,071,845 | 1/1963 | Leonard et al. | 336/206 X |
| 3,125,705 | 3/1964 | Feinberg et al. | 315/278 |
| 3,201,734 | 8/1965 | Halacsy | 336/221 |
| 3,319,206 | 5/1967 | Harloff | 336/221 X |
| 3,474,370 | 10/1969 | Lightner | 336/206 X |
| 3,478,291 | 11/1969 | Lugten | 336/221 X |
| 3,668,588 | 6/1972 | Walsh, Jr. | 336/220 X |
| 3,939,449 | 2/1976 | Boyd et al. | 336/206 X |

*Primary Examiner*—Peter A. Nelson

*Attorney, Agent, or Firm*—Robert F. O'Connell

[57] ABSTRACT

An inductor structure for use in a discharge lamp circuit has wound around at least part of its magnetic core first and second conducting foils. The first conducting foil is insulated from the magnetic core. The second conducting foil is interwound with but separated and insulated from the first conducting foil by a first dielectric foil and a second dielectric foil interwound with the conducting foils. The conducting foils have different numbers of turns. The conducting foil with the greater number of turns has all its turns except its excess turns wound oppositely to the turns of the other conducting foil. The structure provides a lower level of harmonic content above main frequency in the lamp and mains current waveforms.

4 Claims, 5 Drawing Figures

INDUCTOR STRUCTURES FOR ELECTRICAL DISCHARGE LAMP CIRCUITS

This invention relates to inductor structures for electrical discharge lamp circuits, and especially to an inductor structure having a magnetic core and, wound around at least part of the core, a first conducting foil and a second conducting foil, the first conducting foil being insulated from the magnetic core, and the second conducting foil being interwound with but separated and insulated from the first conducting foil by dielectric material.

A known inductor structure of this kind is described in British patent specification No. 623,501 which discloses a circuit for an electric discharge lamp comprising a ballast in the form of two intercoupled inductance coils connected in series aiding relationship and so that the interwinding capacity serves as a power factor corrector during the normal lamp operation but has substantially negligible effect on the starting circuit. The known inductor structure has two intrwound metal foils forming coils with equal numbers of turns. However, there is a disadvantage in the use of the known inductor structure, and that is that the resultant lamp and mains current waveform contain unsatisfactorily high levels of harmonics above the fundamental mains frequency. It is therefore the object of the present invention to provide an inductor structure for use in an electrical discharge lamp circuit which provides a lower level of harmonic content above the mains frequency in the lamp and mains current waveforms.

According to the present invention, then, an inductor structure of the kind defined hereinbefore is characterized by the fact that the first and second conducting foils provide respective different numbers of turns, and that one of the conducting foils providing the greater number of turns being so wound that those of its turns which are in excess of the number of turns provided by the other conducting foil are wound in the opposite direction to the turns of the said other other conducting foil and of the remaining turns of the said one of the conducting foils.

In use, in an electrical discharge lamp circuit, one end of each of the conducting foils is connected to a respective lamp terminal, the ends chosen being such that when alternating current is supplied at the other ends of the conducting foils, the magnetic fields of the conducting foil providing the smaller number of turns and the said remaining turns of the other conducting foil oppose one another when the lamp is operating.

In one preferred embodiment of the invention, the said dielectric material is in the form of a first dielectric foil and a second dielectric foil so interwound with the first and second conducting foils that the second conducting foil is separated from the first conducting foil by the first dielectric foil, and the second dielectric foil is separated from the first dielectric foil by the second conducting foil.

In another preferred embodiment, the said dielectric material is in the form of coatings of dielectric material on the first and second conducting foils.

An example of an embodiment of the invention will now be described with reference to the accompanying drawings in which.

Figure 1:
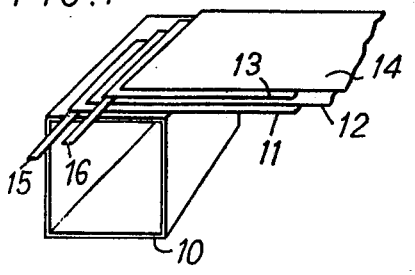
FIG. 1 is a perspective view of a part of an embodiment of the invention being made.
Figure 2:
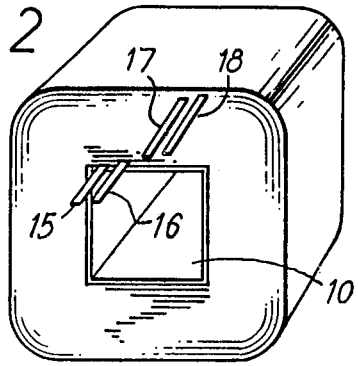
FIG. 2 is a perspective view of the completed part of FIG. 1.

In FIG. 1 there is shown a tubular former 10 which is of square cross section and is formed of an insulating material. A four-layer sandwich consisting of a first conducting foil 11, a first dielectric foil 12, a second conducting foil 13 and a second dielectric foil 14 are being wound around the former 10. Terminal tags 15 and 16 are soldered to the respective inner ends of the foils 11 and 13 shown in FIG. 1. Terminal tags 17 and 18 are soldered to their outer ends and are shown in FIG. 2. The inner ends of the four foils 11 to 14 are staggered slightly so that the foils 11 to 14 will wind smoothly around in successive layers. For clarity, this staggering is exaggerated in FIG. 1. Furthermore, to prevent the foil 11 contacting its inner end and that of the foil 13 on completion of the first turn of the winding, insulating tape, not shown, is secured over the staggered inner ends of the foils to provide insulation from the first turn of the foil 11. The foils 11 and 12 are of equal length, and the foils 13 and 14 are of equal length, the latter pair of foils being longer than the former pair so that the foils 13 and 14 can be continued for a further number of turns N2 in the opposite direction, after all four foils having made a first number N1 of turns in the same direction. In one example of a constructed embodiment, N1 is 150 turns, and N2 is 950 turns.

The wound foils are finally bound round with insulating tape 19.

Figure 3:
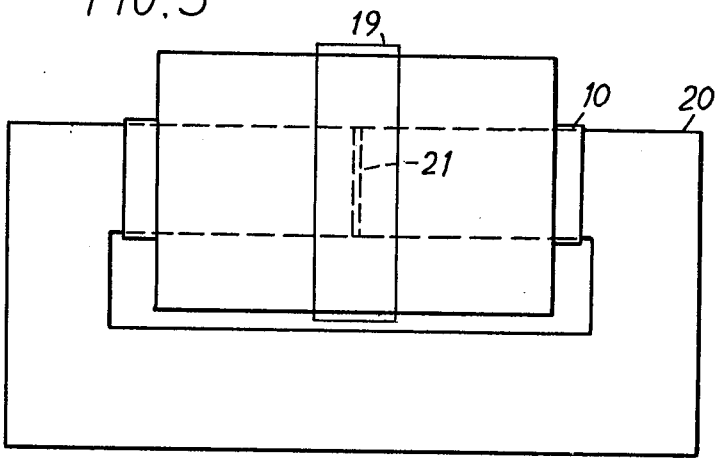
FIG. 3 is a side view of an embodiment of the invention.

The former 10 is fitted on part of a laminated iron core 20 having an air gap 21 located midway along the interior of the former 10 (see FIG. 3).

Figure 4:
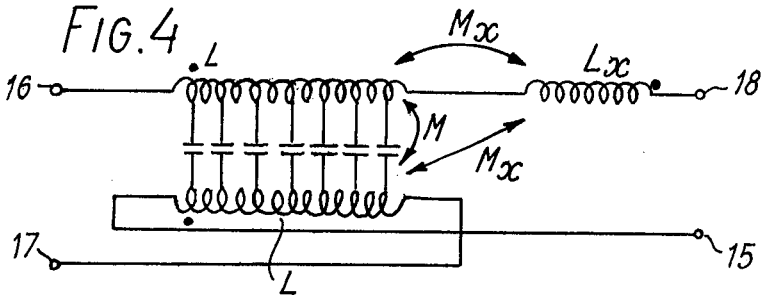
FIG. 4 is a circuit diagram of the embodiment of FIG. 3.

FIG. 4 shows the electrical circuit components constituted by the embodiment of FIG. 3. The N1 turns of the first conducting foil 11 have a self inductance L, the N1 turns of the first part of the second conducting foil 13 also have a self inductance L, and the N2 turns of the second part of the second conducting foil 13 have a self inductance $L_x$. Between the foil 11 and the first part of the foil 13 there is a mutual inductance M, and between the foil 11 and the second part of the foil 13 there is a mutual inductance $M_x$. Also, between the first and second parts of the foil 13 there is a mutual inductance $M_x$.

In the said constructed example in which N1 is 150 turns and N2 is 950 turns the cross sectional area of the laminated iron core 20 is 14 square centimeters, the dielectric foils 12 and 14 are of polypropylene, and the conducting foils 11 and 13 are of aluminium. The values of L and Lx are, respectively, 0.44 henrys and 1.78 henrys, in this example.

There is a distributed capacitance C between the foils 11 and 13 indicated in FIG. 4, and in the example constructed the value of C is 3 microfarads.

In use, the terminal tags 16 and 17 are connected to an A.C. supply, and the terminals 15 and 18 are connected to the lamp terminals, so that the magnetic field of the foil 11 opposes that of the second part of the foil 13.

If the lamp is fluorescent lamp or a cold cathode discharge lamp, no starter switch is needed. If the lamp is a heated cathode lamp, the terminals 15 and 18 are again connected to the cathode terminals of the lamp, and, in this case, a heater supply is provided which is separate from the lamp starting and operating circuit of FIG. 4, the heater supply being the output of a separate transformer (not shown) whose primary is separately connected to the mains supply or other A.C. supply.

By correct selection of the numbers N1 and N2 of the turns and of the width of the conducting foils 11 and 13 and the thicknesses of the dielectric foils 12 and 14, an embodiment of the invention used in a lamp starting and operating circuit can produce a high enough voltage for any fluorescent lamp, and some cold cathode lamps, to strike. Once the lamp has struck, the harmonic content of an A.C. mains supply current waveform, and the lamp current waveform, can be kept low.

Figure 5:
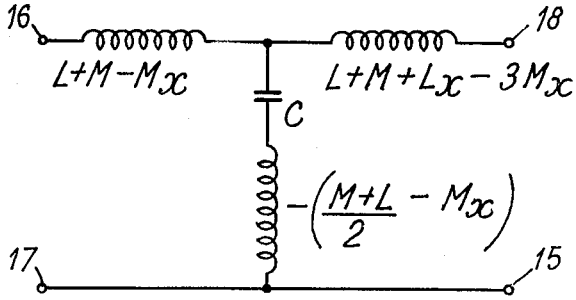
FIG. 5 is an equivalent circuit diagram of the embodiment of FIG. 3.

FIG. 5 shows a substantially equivalent circuit for FIG. 4. It will be appreciated from the description above of FIG. 4 that $M = K_1\sqrt{L \cdot L}$, where $K_1$ is a coupling coefficient, and $M_x = K_2\sqrt{L \cdot L_x}$ where $K_2$ is another coupling coefficient. In practice $K_1$ and $K_2$ are approximately equal and can be replaced by a common coupling coefficient K.

Before the lamp strikes, the resonant frequency of the equivalent circuit is $$F_o = 1/\pi\sqrt{2C\,(L+M)}$$

For the purposes of design, $$L = [\mu_o\mu(N1)^2A]/l \text{ henrys}$$

where $l$ meters in the effective magnetic length of the foil 11;

$A$ square meters is the effective magnetic cross sectional area of the foil;

N1 is the number of turns;

$\mu_o$ henrys per meter is the absolute permeability of free space; and $\mu$ is the relative permeability of the iron core.

$$L_x = [\mu_o\mu(N2)^2A]/l_x \text{ henrys}$$

where $l_x$ meters is the effective magnetic length of the second part of the foil 13.

$$C = (\epsilon_o\,\epsilon A_d)/d \text{ farads}$$

where $\epsilon_o$ farads per meter is the absolute permittivity of free space;

$\epsilon$ is the relative permittivity of the dielectric material of the foils 12 and 14:

$A_d$ square meters is the area presented by the first dielectric foil 12; and $d$ meters is the thickness of the foil 12.

Although in the embodiment described above the first foils 11 and 12 are shorter than the second foils 13 and 14, an embodiment can be constructed in which the first foils 11 and 12 are longer than the second foils 13 and 14, the first foils 11 and 12 being continued for a further N2 turns in the opposite direction to the first N1 turns.

If desired or convenient, the further N2 turns may be provided as an extension to one of two conducting foils of equal length, an external electrical connection being made between one end of the two equal foils and the extension foil.

We claim:

1. An inductor structure comprising:

magnetic core means;

a first conducting foils means wound around at least part of the said core means and insulated from the said core means;

a second conducting foil means would around at least part of the said core means and interwound with the said first conducting foil means;

dielectric means separating and insulating said foil means from one another, said first and second foil means being provided with respective different numbers of turns, and that one of the conducting foil means providing the greater number of turns being so wound that those of its turns which are in excess of those of its turns which are equalled by the other conducting foil means are wound in the opposite direction to the turns of the said other conducting foil means and the said equalled turns of the said one of the conducting foil means.

2. An inductor structure as claimed in claim 1, wherein the said dielectric means comprises first dielectric foil means and second dielectric foil means so interwound with the first and second conducting foil means that the second conducting foil means is separated from the first conducting foil means by the first dielectric foil means, and the second dielectric foil means is separated from the first dielectric foil means by the second conducting foil means.

3. An inductor structure as claimed in claim 2 and connected in an electrical discharge lamp circuit, one end of each of said conducting foil means being connected to a respective discharge lamp terminal, whereby when alternating current is supplied at the other ends of said conducting foil means, the magnetic fields of the conducting foil means providing the smaller number of turns and said equalled turns of said other conducting foil oppose one another when said lamp is operating.

4. An inductor structure comprising magnetic core means;

a first conducting foil means wound around at least part of the said core means and insulated from the said core means;

a second conducting foil means wound around at least part of the said core means and interwound with the said first conducting foil means;

dielectric means separating and insulating said foil means from one another, and one of said conducting foil means providing a greater number of turns than the other of said conducting foil means, wherein said other conducting foil means has self inductance L, said one conducting foil means has self inductance $L + L_x$, the self inductance of said remaining turns being $L_x$, there is distributed capacitance C being said conducting foils, mutual inductance M between said other foil means the corresponding number of turns of said one foil means, mutual inductance $M_x$ between said other foil means and said remaining turns, and mutual inductance $M_x$ between said corresponding number of turns and said remaining turns, and said structure is equivalent to a network having an input inductance $(L + M - M_x)$ coupling an input terminal to a junction point, an output inductance $(L + M + L_x - 3M_x)$ coupling an output terminal to said junction point, a capacitance C coupling said junction point to a further inductance $-(M + L/Z - M_x)$ connected to directly connected input and output terminals.

* * * * *